United States Patent [19]

Maese et al.

[11] 4,272,183

[45] Jun. 9, 1981

[54] CONTROL SYSTEM RESPONSIVE TO ERASER MALFUNCTIONS IN ELECTROPHOTOGRAPHIC COPYING MACHINES

[75] Inventors: Masayuki Maese; Tsuyoshi Nakakami, both of Toyokawa, Japan

[73] Assignee: Minolta Camera Kabushiki Kaisha, Osaka, Japan

[21] Appl. No.: 50,529

[22] Filed: Jun. 21, 1979

[30] Foreign Application Priority Data

Jun. 21, 1978 [JP] Japan ..... 53-86070[U]

[51] Int. Cl.[3] ..... G03G 15/22

[52] U.S. Cl. ..... 355/14 R; 355/14 CH; 355/15

[58] Field of Search ..... 355/14 CH, 14 R, 15, 355/3 R, 3 CH

[56] References Cited

U.S. PATENT DOCUMENTS

| | | | |
|---|---|---|---|
| 3,851,966 | 12/1974 | Reehil et al. | 355/14 R |
| 3,999,851 | 12/1976 | Sakamaki et al. | 355/14 R |
| 4,013,358 | 3/1977 | Kawai | 355/14 R |
| 4,089,602 | 5/1978 | Noguchi et al. | 355/14 R |
| 4,095,890 | 6/1978 | Van Herten | 355/14 R |

*Primary Examiner*—William H. Beha, Jr.
*Attorney, Agent, or Firm*—Watson, Cole, Grindle & Watson

[57] ABSTRACT

A control system for use with an eraser for removing charges from the surface of the photoconductive member of an electrophotographic copying machine before the photoconductive member is uniformly charged by a charger. When the eraser malfunctions, completely or substantially failing to operate properly, the control circuit detects the malfunction and stops the operation of at least the charger to prevent a rise in the surface potential of the photoconductive member.

7 Claims, 6 Drawing Figures

CONTROL SYSTEM RESPONSIVE TO ERASER MALFUNCTIONS IN ELECTROPHOTOGRAPHIC COPYING MACHINES

FIELD OF THE INVENTION

The present invention relates to a control system for electrophotographic copying machines, and more particularly to a control system which, when the eraser for removing charges from an electrophotographic photoconductive member malfunctions, detects the malfunction to stop the operation of at least the charger.

BACKGROUND OF THE INVENTION

With electrophotographic copying machines, the surface of the photoconductive member is uniformly charged by a charger and then exposed to the image of an original to form a latent electrostatic image, which is thereafter converted to a visible image with toner particles. After the toner image has been transferred to copy paper, the toner and charges remaining on the surface of the photoconductive member are removed therefrom to make the photoconductive member repeatedly usable. Thus, after the transfer of the toner image during such a copying cycle, the residual charges are removed from the photoconductive surface to reduce the surface potential approximately to zero volts, permitting the charger to give a uniform potential to the photoconductive surface for the subsequent copying cycle. When the charge eraser malfunctions for one cause or another, completely or substantially failing to operate properly, the copy image is adversely affected, while the potential will abnormally build up on the surface of the photoconductive member, possibly causing damage thereto.

Although such faults are inherent in the operation of the eraser, conventional copying machines are not specifically adapted to detect the malfunction of the eraser and to effect the desired control in the event of malfunctioning.

Moreover since the malfunction of the eraser is usually very difficult to detect for the user, it is substantially impossible to preclude accidents such as damage or breakdown of the photoconductive member. In that context, there is also a need to provide a system for detecting the malfunction of the eraser and automatically controlling the charger and the like.

SUMMARY OF THE INVENTION

The main object of the invention is to provide a control system for stopping the operation of at least a charger on detecting the malfunction of a charge eraser to prevent damage to a photoconductive member.

Another object of the invention is to provide various systems for detecting the malfunction of an eraser lamp for illuminating the surface of a photoconductive member to remove charges therefrom.

Briefly, the electrophotographic copying machine according to the invention is provided with means for detecting the malfunction of the charge eraser and control means for stopping the operation at least of the charger in response to the output of the detecting means, so that even if the eraser malfunctions for one cause or another and substantially or completely fails to perform the desired charge removing operation, the control means functions to prevent the accumulation of charges on the photoconductive member, thus precluding the possible damage to the photoconductive member.

DETAILED DESCRIPTION OF THE INVENTION

Figure 1:
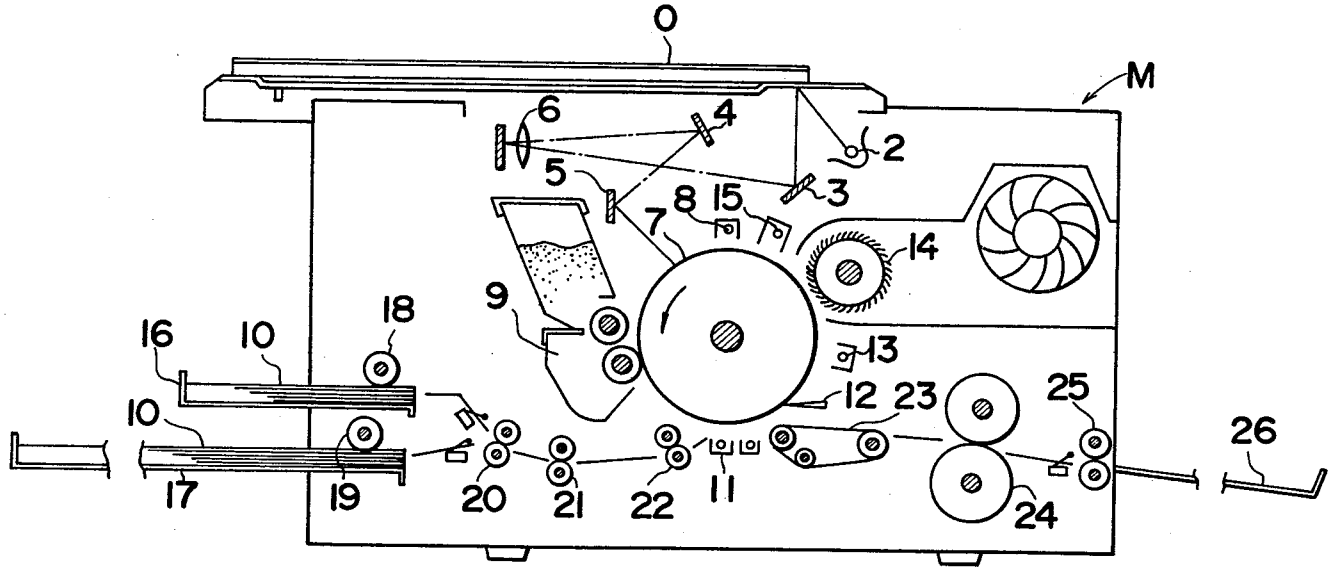
FIG. 1 is a diagram showing an electrophotographic copying machine incorporating a control system of the invention.

With reference to FIG. 1 showing electrophotographic copying machine M incorporating a control system of the invention, the construction and operation of copying machine M will be described briefly. Machine M includes carriage O which is reciprocally movable for placing thereon the original to be copied. When carriage O travels rightward in the drawing for scanning, the image of the original is illuminated by exposure lamp 2 and is continuously projected on rotating photoconductive member 7 by mirrors 3, 4, 5 and lens mirror 6. Arranged around photoconductive member 7 are charger 8 for uniformly charging the surface of photoconductive member 7, developing unit 9 for developing latent electrostatic images, transfer charger 11 for transferring the developed images onto copy paper 10, pawl 12 for separating copy paper 10 from photoconductive member 7, first eraser 13 for eliminating residual charges, cleaner brush 14 for removing the residual toner from member 7, and second eraser 15 for removing the residual charges from the surface of photoconductive member 7 again after the surface thereof has passed the cleaner structure.

Different sized sheets of copy paper 10 are accommodated in upper and lower cassettes 16 and 17. An unillustrated copy size selector switch, when operated, conditions either one of feed rollers 18 and 19 to feed copy paper 10, and a sheet of copy paper 10 is sent out. Upon the engagement of the leading end of copy paper 10 with the nip of timing rollers 20, the copy paper is temporarily halted to time its transport with the movement of the latent image on photoconductive member 7. The paper thereafter starts to travel again and is transported by feed rollers 21 and 22 to the transfer station. The copy paper bearing a toner image transferred thereto is transported on conveyor belt 23, passed over fixing heat roller 24, then between discharge rollers 25 and delivered onto tray 26.

With the photocopying machine M, second eraser 15 serves to remove the charges remaining on the toner bearing portion of the photoconductive surface after the residual toner has been removed therefrom by cleaner brush 14.

As will be described later, first and second erasers 13 and 15 each comprise eraser lamp L1 for illuminating the surface of the photoconductive member to remove charges therefrom utilizing the photoelectric conductivity of the member. These erasers are of the type most widely used in electrophotographic copying machines.

The control system of this invention described below, may be used for either one of the first and second erasers or for both the erasers at the same time.

Figure 2A:
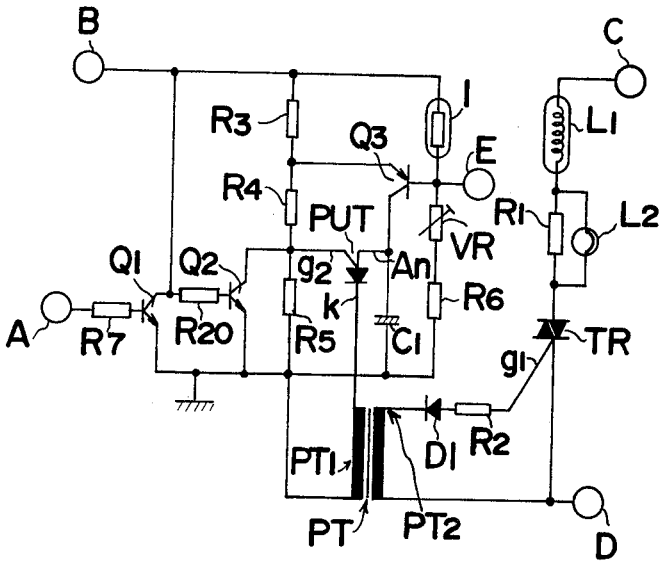
FIGS. 2*a* and 2*b* are circuit diagrams showing an embodiment of the control system of the invention.
Figure 2B:
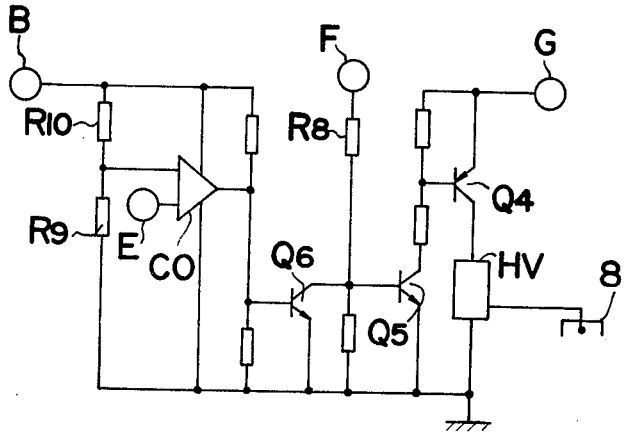

FIGS. 2*a* and 2*b* show a circuit for detecting a reduction in the amount of light from eraser lamp L1 to interrupt the supply of current to charger 8, the circuit further being adapted to control the amount of light from eraser lamp L1 by phase control.

Eraser lamp L1 is connected to a-c voltage input terminals C and D through bidirectional thyristor (hereinafter referred to as "TRIAC"), TR, and resistor R1, with auxiliary light source L2 connected in parallel therewith. Gate g1 of TRIAC TR is connected to output terminal PT2 of the secondary winding of pulse transformer PT via resistor R2 and diode D1.

Photoelectric cell 1 is disposed on a suitable portion of the circuit base panel to receive the light from auxiliary light source L2 (see FIG. 3) and forms a bridge along with resistors R3, R4, R5, R6 and variable resistor VR. Constant-voltage d-c input terminal B is connected to the above-mentioned bridge circuit.

Output terminal A of a rectifier (not shown) for the full-wave rectification of the current of the above-mentioned a-c power supply is connected via resistor R7 to the base of transistor Q1, the collector of which is connected to the base of transistor Q2 through resistor R20. Transistor Q1 is brought out of conduction at the zero points of the full-wave rectified wave to make transistor Q2 conductive only when transistor Q1 is OFF. The collector of transistor Q2 and gate g2 of a programmable unijunction transistor (hereinafter referred to as "PUT") are connected to the junction between resistors R4 and R5. Unijunction transistor PUT has anode An connected to the junction between capacitor C1 and the collector of transistor Q3, and cathode K connected to the input terminal of primary winding PT1 of pulse transformer PT.

Transistor Q3 has a base connected to the junction of photoelectric cell 1 and variable resistor VR, and an emitter connected to the junction of resistors R3 and R4.

With the circuit described above, eraser lamp L1 and auxiliary light source L2 are subjected to the same phase control by TRIAC TR. When the amount of light to be applied to photoelectric cell 1 varies because of, for example, a voltage variation, the voltage to be impressed on the base of transistor Q3 varies, producing a variation in the rate at which capacitor C1 is charged. As a result, the voltage at anode An of unijunction transistor PUT, namely the charge voltage on capacitor C1 is discharged with altered timing relative to the fixed voltage to be applied to gate g2 of unijunction transistor PUT, altering the timing with which gate g1 of TRIAC TR is triggered by pulse transformer PT and thereby effecting phase control to keep the amount of light from eraser lamp L1 constant. The switching circuit afforded by transistors Q1 and Q2 serves to time the charging of capacitor C1 to the a-c waveform, such that the voltage on gate g2 of unijunction transistor PUT is reduced to zero at every zero point of the a-c waveform to discharge capacitor C1.

With reference to FIG. 2*b*, charger 8 is connected to constant-voltage power supply terminal G through high-voltage supply HV and transistor Q4, which, along with transistors Q5 and Q6, provides a switching circuit.

The collector of transistor Q6 is connected, by resistor R8, to power supply terminal F for controlling the operation of high-voltage power supply HV and is also connected to the base of transistor Q5. A signal is fed to power supply terminal F in operative relation to the copying cycle of photocopying machine M. While the signal voltage is applied to terminal F, transistors Q5 and Q4 are in conduction, thereby maintaining charge 8 operative.

To obtain output from the above-described bridge circuit including photoelectric cell 1 in accordance with the variation in the amount of light impinging thereon, the junction of photoelectric cell 1 and variable resistor VR is connected to terminal E, the output from which is fed to comparator CO (FIG. 2*b*). Constant-voltage power supply B applies divided voltage, which is determined by resistors R9 and R10, to another input terminal of comparator CO, which provides an output to the base of transistor Q6.

If eraser lamp L1 included in the foregoing circuit malfunctions, for example, because of an open circuit or a broken lamp, auxiliary light source L2 also fails to light, thereby projecting no light on photoelectric cell 1. The resulting increase in the internal resistivity of photocell 1 causes a reduced voltage at output terminal E. When that output voltage drops to a level lower than a specified value, comparator CO produces a "HIGH" output, allowing transistor Q6 to conduct and bringing transistors Q5 and Q4 out of conduction to interrupt the supply of current to charger 8.

Moreover, when the power supply to eraser lamp L1 reduces for whatever reason, thereby failing to assure the desired charge erasing operation, the amount of light from auxiliary light source L2 also reduces at the same time. The resulting reduction in the output voltage at terminal E turns off charger 8 in the same manner as in the above-described case.

To control the amount of light from eraser lamp L1, photoelectric cell 1 of the present embodiment is adapted to detect the light from auxiliary light source L2 which is subjected to the same phase control as eraser lamp L1. Such operation is advantageous in that auxiliary light source L2 and photoelectric cell 1 can be arranged in the desired position without limitations. In accordance with the basic feature of this invention, however, photoelectric cell 1 may be adapted to receive light directly from eraser lamp L1.

While the control circuit is designed to turn off charger 8 when the amount of light from eraser lamp L1 is reduced to a specified level, this level can be determined suitably in accordance with the values of resistors R9, R10, etc. with consideration also given to other factors involved in the copying machine.

Figure 3:
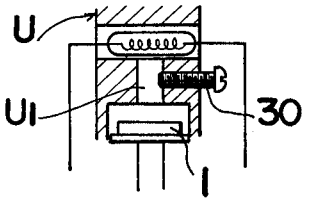
FIG. 3 is a diagram showing an arrangement of an auxiliary light source and a photoelectric cell.

FIG. 3 shows a specific arrangement of auxiliary light source L2 and photoelectric cell 1 relative to each other. Unitary mount U fixedly houses auxiliary light source L2, which projects light on photoelectric cell 1 through bore U1. The amount of light incident on photocell 1 is adjustable by advancing or retracting the forward end of adjusting screw 30.

Figure 4:
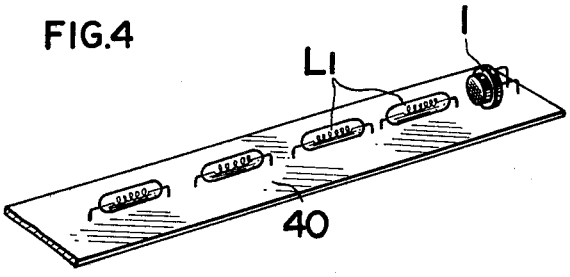
FIG. 4 is a diagram showing an arrangement in which the light from a plurality of eraser lamps is directly detected by a photoelectric cell.

FIG. 4 shows another arrangement in which the light from eraser lamps L1 is directly detected by photoelectric cell 1. Eraser lamps L1 are arranged in series on base plate 40 and project light on photocell 1 mounted to one end of base plate 40. The circuit including this arrangement corresponds to the circuit of FIG. 2*a* from which auxiliary light source L2 and resistor R1 are omitted (although resistors of different values are then used because of the difference between auxiliary light source L2 and eraser lamps L1 in the amount of emitted light).

Figure 5:
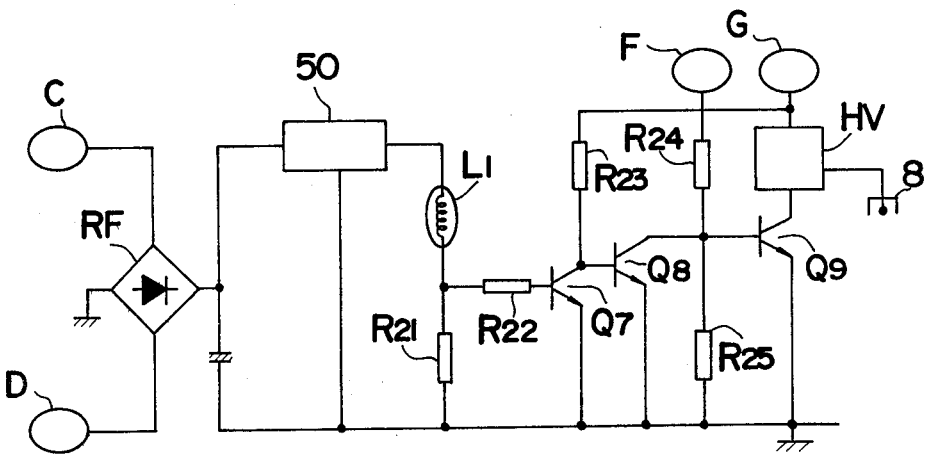
FIG. 5 is a circuit diagram of another embodiment of the invention.

FIG. 5 shows the circuit of another embodiment in which the current through eraser lamp L1 is detected to control the operation of charger 8. The current from a-c power supply input terminals C and D is rectified by rectifier RF, the output of which is provided to eraser lamp L1 through constant-voltage circuit 50. The junction of eraser lamp L1 and resistor R21 is connected through resistor R22 to the base of transistor Q7. Transistor Q8 has its base connected to the collector of transistor Q7 and an emitter which is grounded. The collector of transistor Q8 is connected to the junction between resistors R24 and R25, and resistor R24 is connected to the same input terminal F as in the circuit of FIG. 2*b* for receiving a signal to operate charger 8. The collector of transistor Q8 is further connected to the base of transistor Q9 which is a switching transistor for high-voltage power supply HV.

If a break occurs in eraser lamp L1, no current flows through resistor 21 to make transistor Q7 nonconductive and transistor Q8 conductive to thereby reduce the base voltage of transistor Q9. Transistor Q9 is turned off to interrupt the supply of current to high-voltage power supply HV. Accordingly, even when eraser lamp L1 malfunctions, the circuit, like the circuit shown in FIGS. 2*a* and 2*b*, functions to prevent an accident such as a breakdown of photoconductive member 7 due to a rise of the potential on the surface thereof.

When detecting a malfunction of the eraser in accordance with the variation of voltage, the photocopying machine, if equipped with a microcomputer or like digital control system, may be adapted to detect the malfunction and control the charger by use of the program and judging function of the system.

While the foregoing embodiments are adapted to interrupt the operation of the charger on detecting the malfunction of the eraser, the system may further be designed to give some indication, or stop the copying machine by use of the detecting signal.

If the circuit for controlling the amount of light of an eraser lamp is also made serviceable to detect the malfunction of the lamp as shown in FIGS. 2*a*, 2*b* 3 and 4, a very useful control circuit can be provided with a reduced number of special additional parts.

What is claimed is:

1. In an electrostatic copying apparatus having at least a movable photoconductive member, charging means for uniformly charging the surface of the photoconductive member, exposing means for exposing a light image of an original to the charged surface of the photoconductive member and for forming an electrostatic latent image on the surface of the photoconductive member, transfer means for transferring the image formed on the surface of the photoconductive member to a copying paper, an erasing lamp between the transferring means and the charging means for erasing residual charges on the surface of the photoconductive member, and controlling means for controlling at least an operation of the charging means, said controlling means comprising:

detecting means for detecting malfunction of said erasing lamp and including means for detecting a variation in the amount of light emitted from said erasing lamp and generating a signal when said amount of light fails to assure the desired charge erasing operation; and circuit means for disabling at least the operation of said charging means when said signal is generated from said detecting means.

2. In an electrostatic copying apparatus having at least a movable photoconductive member, charging means for uniformly charging the surface of the photoconductive member, exposing means for exposing a light image of an original to the charged surface of the photoconductive member and for forming an electrostatic latent image on the surface of the photoconductive member, transfer means for transferring the image formed on the surface of the photoconductive member to a copying paper, an erasing lamp between the transferring means and the charging means for erasing residual charges on the surface of the photoconductive member, and controlling means for controlling at least an operation of the charging means, said controlling means comprising:

detecting means for detecting malfunction of said erasing lamp and for generating a signal when said erasing lamp fails to assure the desired charge erasing operation and including a bridge circuit with a photodetector element in one arm thereof, means for energizing said erasing lamp with a periodic phase controllable signal to emit light therefrom to be detected by said photodetector element, said bridge circuit generating a reference signal related to the current through said photodetector element; and circuit means for disabling at least the operation of said charging means and including means for comparing said bridge reference signal with a second reference signal for de-energizing said means for charging with said bridge reference signal less than said second reference signal.

3. In an electrostatic copying apparatus as in claim 2 wherein said means for detecting further includes means for storing the current generated by said photodetector element, means for periodically discharging said means for storing in accordance with an A.C. power signal, said means for energizing including a pulse transformer having a primary winding and control means responsive to the discharge current of said means for storing to energize said primary winding, a bi-directional control means gated by the output from the secondary winding of said pulse transformer for phase control excitation of said erasing means.

4. In an electrostatic copying apparatus as in claim 3 wherein said control means includes a unijunction transistor having an anode element connected to said means for storing, a second gate element responsive to said A.C. power supply, and a cathode connected to the primary winding of said pulse transformer.

5. In an electrostatic copying apparatus as in claim 2, 3 or 4 further comprising auxiliary light emitting means energized by said means for energizing for emitting light to be detected by said photodetector element.

6. In an electrostatic copying apparatus having at least a movable photoconductive member, charging means for uniformly charging the surface of the photoconductive member, exposing means for exposing a light image of an original to the charged surface of the photoconductive member and for forming an electrostatic latent image on the surface of the photoconductive member, transfer means for transferring the image formed on the surface of the photoconductive member to a copying paper, an erasing lamp between the transferring means and the charging means for erasing residual charges on the surface of the photoconductive member, and controlling means for controlling at least an operation of the charging means, said controlling means comprising:

detecting means for detecting malfunction of said erasing lamp and including means for detecting an electric current flowing to said erasing lamp and generating a signal when said current fails to assure the desired charge erasing operation; and circuit means for disabling at least the operation of said charging means when said signal is generated from said detecting means.

7. In an electrostatic copying apparatus having at least a movable photoconductive member, charging means for uniformly charging the surface of the photoconductive member, exposing means for exposing a light image of an original to the charged surface of the photoconductive member and for forming an electrostatic latent image on the surface of the photoconductive member, transfer means for transferring the image formed on the surface of the photoconductive member to a copying paper, an erasing lamp between the transferring means and the charging means for erasing residual charges on the surface of the photoconductive member, and controlling means for controlling at least an operation of the charging means, said controlling means comprising:

detecting means for detecting malfunction of said erasing lamp and for generating a signal when said erasing lamp fails to assure the desired charge erasing operation;

a constant current source for energizing said erasing lamp; and circuit means for disabling at least the operation of said charging means when said signal is generated from said detecting means and including switching means responsive to the current through said erasing lamp for disabling the high voltage power supply energizing said means for charging.

* * * * *